US007270501B2

(12) United States Patent
Kanflod et al.

(10) Patent No.: US 7,270,501 B2
(45) Date of Patent: Sep. 18, 2007

(54) EXPANDABLE ROCK BOLT AND ROCK BOLTING SYSTEM

(75) Inventors: Morgan Kanflod, Örebro (SE); Fredrik Öberg, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 10/555,030

(22) PCT Filed: May 12, 2004

(86) PCT No.: PCT/SE2004/000732

§ 371 (c)(1),
(2), (4) Date: Oct. 27, 2005

(87) PCT Pub. No.: WO2004/099571

PCT Pub. Date: Nov. 18, 2004

(65) Prior Publication Data

US 2006/0285928 A1 Dec. 21, 2006

(30) Foreign Application Priority Data

May 12, 2003 (SE) ..... 0301374

(51) Int. Cl.
*E21D 21/00* (2006.01)
*E21F 17/02* (2006.01)

(52) U.S. Cl. ..... 405/259.3; 405/302.1

(58) Field of Classification Search ..... 405/259.1, 405/259.3, 302.1, 302.2
See application file for complete search history.

(56) References Cited

U.S. PATENT DOCUMENTS

| | | | | |
|---|---|---|---|---|
| 2,486,113 | A * | 10/1949 | Campbell et al. | 285/102 |
| 3,027,140 | A * | 3/1962 | Holzbach | 254/98 |
| 3,651,651 | A | 3/1972 | Triplett | |
| 4,255,070 | A * | 3/1981 | Calhoun | 405/259.5 |
| 5,997,219 | A | 12/1999 | Krzysztalowicz et al. | |

FOREIGN PATENT DOCUMENTS

| | | | |
|---|---|---|---|
| EP | 272233 | A1 * | 6/1988 |
| SE | 427764 | | 5/1983 |
| SE | 443398 | | 2/1986 |
| WO | WO2005119009 | A1 * | 12/2005 |

* cited by examiner

*Primary Examiner*—John Kreck
(74) *Attorney, Agent, or Firm*—Mark P. Stone

(57) ABSTRACT

The present invention is related to a rock bolt (7), expandable by means of a pressure media, for insertion into a borehole. The expandable bolt (7) comprises a connection unit (8) with means (11) for detachable interaction with an expansion means (10) for expansion of the rock bolt (7), as well as with a suspension element (16). The connection unit is designed with such external dimensions so that it may be inserted into the bore-hole. The invention also relates to such a rock bolting system.

10 Claims, 5 Drawing Sheets

EXPANDABLE ROCK BOLT AND ROCK BOLTING SYSTEM

TECHNICAL FIELD

The present invention is related to expandable rock bolts for use as suspension attachments.

BACKGROUND OF THE INVENTION

In tunneling and in mines there is often a need for suspending different devices used in the work, for example ventilators, drilling equipment and the like. Additionally, in mines and in tunneling one often uses platforms in order to transport excavated material and other material. These platforms are hung up in the roof of the tunnel or mine, which for example may be done by attaching a beam in the roof and then fastening the platform to the beam.

In order to fasten such devices, for example a service platform, to the roof, bolts of different types may be used. Often one uses expandable bolts, so called swelling bolts where the bolt comprises a tube, the interior of which is pressurized by means of a pressure means, such as a high pressure fluid, and thereby expands. An example of such an expandable bolt is showed in the Swedish patent nr. 7902129-1. The expansion bolts may be used with a special coupling, that is fastened to the expansion bolt. The platform, or the devices that one wishes to suspend in the roof, is then fastened in these couplings.

A disadvantage with using these bolts as suspension devices is that they, together with the special suspension coupling, protrude substantially from the roof of the tunnel, and must therefore be cut and/or covered by a thick layer of rendering concrete. This is a costly and time-consuming operation and it would be desirable to be able to minimize it. This bolt with suspension device may not be ranked as supporting of rock in the safety estimates.

SUMMARY OF THE INVENTION

It is an object of the present invention to provide a rock bolt that solves the above-mentioned problems. More specifically, it is an object of the present invention to provide an improved rock bolt for suspension, which entails minimized stress concentrations in the bolt. Another object of the present invention is to provide a suspension device that simplifies the work when moving into a rock.

These and other objects are achieved in accordance with the present invention by an expandable rock bolt as defined in claim 1.

In accordance with the present invention the above mentioned objects are achieved by providing a expandable rock bolt, that can be expanded by means of a pressure media, with a connection unit including means for interaction with means for expanding the rock bolt as well as suspension elements. The connection unit is further designed with such exterior dimensions that it may be inserted into a borehole. Thereby a suspension device is provided that gives a smaller protrusion from the rock, and that provides a better strength.

In accordance with a preferred embodiment, the connection unit comprises a connection sleeve fastened to the rock bolt. Thereby a practical and easy to use connection of the suspension elements and expansion means, respectively, is provided. This connection sleeve may be inserted into the borehole and thereby gives a minimal protrusion from the rock into the tunnel being covered, which results in a faster and more efficient tunneling work.

In accordance with another preferred embodiment the connection sleeve may be welded to the rock bolt, which gives a more safe and at the same time economical and practical attachment of the connection sleeve to the rock bolt.

In accordance with another preferred embodiment the connection unit's connection sleeve comprises an organ, for example a flange, against which a rock plate may abut. This gives the rock bolt according to the present invention rock supporting qualities, whereby the rock bolt combines two important and useful functions, namely supporting of rock and suspension, in one and the same rock bolt. The rock plate may further be chosen as appropriate and depending on the requirements, and may for example comprise a regular flat rock plate or e.g. a domed rock bolt. In accordance with this aspect of the invention the expandable rock bolt may thus be used both as rock support and as a suspension device. Thereby the total cost for providing suspension devices and rock support may be decreased, giving an economical solution.

In accordance with another preferred embodiment the connection unit comprises a supporting sleeve, surrounding at least parts of the seat of the connection unit. Thereby the rock bolt is prevented from being exposed to bending moment due to the fact that the bolt rests against the wall of the hole.

In accordance with another preferred embodiment two rock bolts may be joined and thereby provide a longer rock bolt. The rock bolt in accordance with the present invention may alternatively be used only as the outermost part, protruding from the rock, whereby regular on the market existing likewise or otherwise expandable rock bolts, without a connection unit for suspension and plate, may be used farthest in, in the borehole.

In accordance with another preferred embodiment the suspension element may comprise one of the following: mounting lug, a single hook, a double hook, a catch or a combination thereof. Great flexibility is thereby provided, and the suspension element may be adapted as required.

The present invention also relates to a rock bolting system comprising an expandable rock bolt as above, and expansion nipple and suspension element, whereby advantages, corresponding to the above described, are achieved.

Further advantages are achieved by different aspects of the invention and will become clear by the following detailed description.

DETAILED DESCRIPTION OF PREFERRED EMBODIMENTS

As was described above there is often a need for suspending various devices in a mine or in a tunneling work. In rock drilling supporting of rock of some kind is needed, for example rock bolts, cables or other elements, in order to strengthen and stabilize the rock and thereby making the rock self-supporting. As was described in the introductory part there are expandable, tubular rock bolts that may be used for this purpose, see for example the Swedish patents no. 427 764 and 443 398.

The present invention provides an improved rock bolt, which may also be provided with a suspension device giving a minimal protrusion, and that at the same time provides a way to combine these two needs existing in a rock drilling environment, for example in a mine, in one and the same rock bolt.

Figure 1:
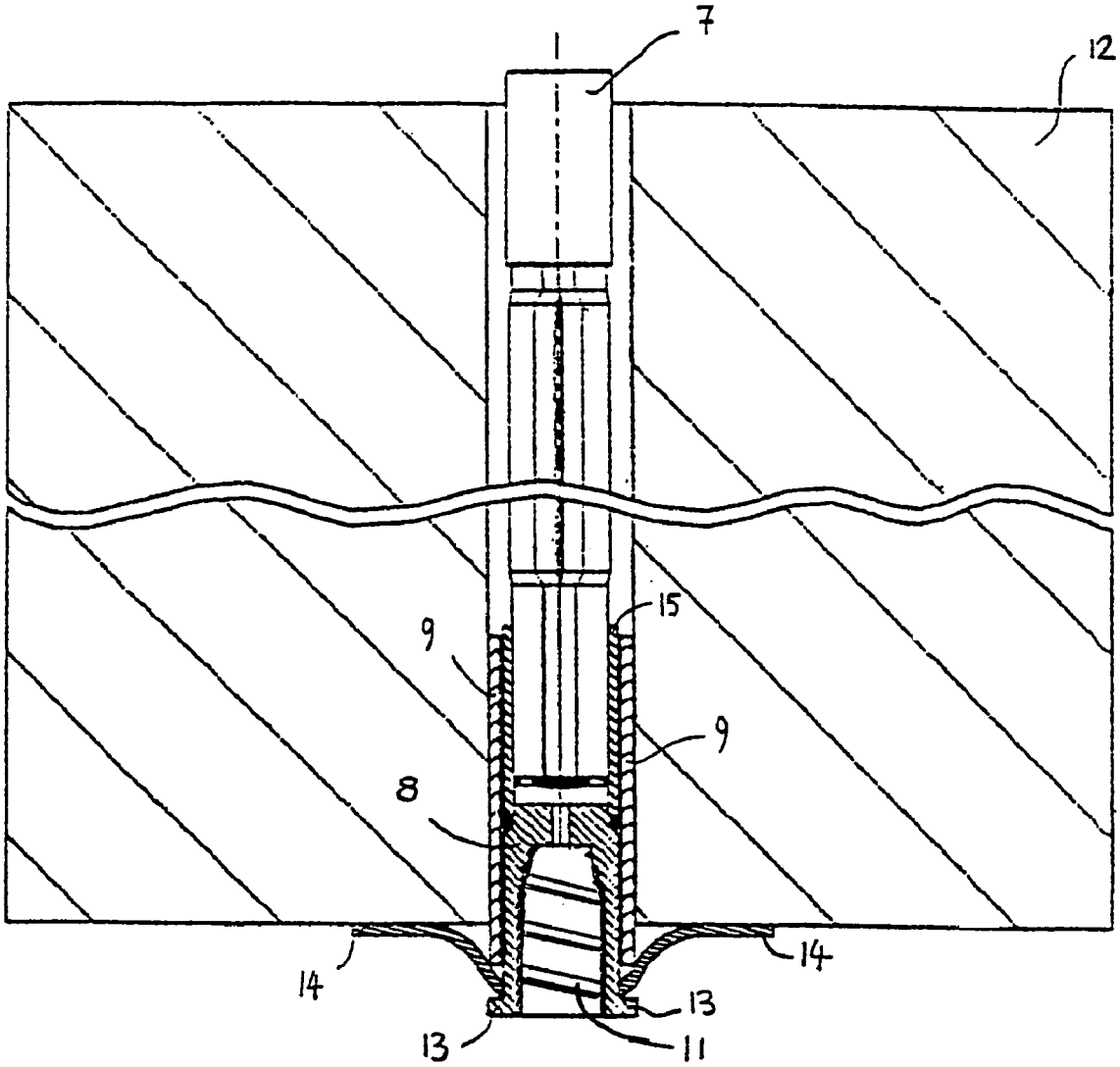
FIG. 1 shows a rock bolt in accordance with the invention.

With reference now to FIG. 1, a rock bolt 7 in accordance with the present invention is shown. The by a pressure media expandable rock bolt 7 comprises a connection unit for connection both of an expansion means 10 (see FIG. 2) and for connection of a suspension element 16 (see FIG. 3). The connection unit preferable comprises a connection sleeve 8 with a seat comprising internal means 11 for reception both of the expansion organ 10 for expanding the rock bolt 7 and of a suspension element 16. The internal means 11 of the seat may for example comprise threads, whereby the expansion means 10 and the suspension element 16, respectively, may be screwed on to the rock bolt 7. Alternatively, as is shown in the FIGS. 4*a* and 4*b*, the connection sleeve 8 may instead comprise external threads for interaction with the expansion means 10 and suspension element 16, respectively. This must however be done without substantially lengthen the protrusion of the rock bolt from the rock, for example so that a sleeve like part of the expansion means 10 and the suspension means 16 have such dimensions that they may be inserted into the borehole. Other suitable detachable connections are also conceivable.

The connection unit preferably also comprises a supporting sleeve 9, which is fastened to the rock bolt 7. The parts of the connection unit, that is, the connection sleeve 8 and the supporting sleeve 9 in case such is present, may in an alternative embodiment be integrated. Furthermore, the supporting sleeve 9 prevents any undesired angular displacements between the connection sleeve 8 and the rest of the rock bolt 7 thanks to the fact that the sleeve supports against the wall of the hole.

Figure 2:
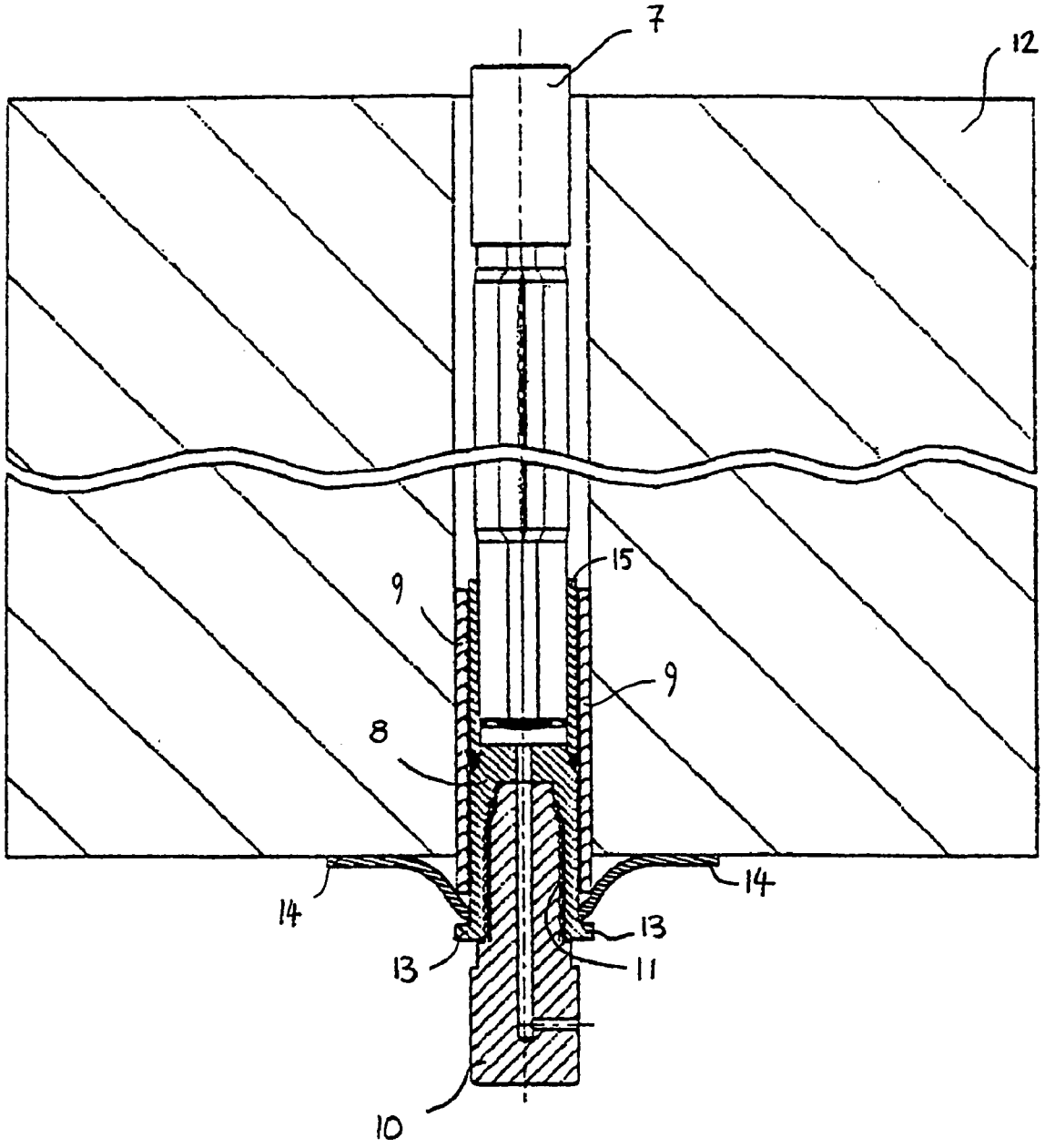
FIG. 2 shows the rock bolt of FIG. 1 provided with a detachable expansion nipple in accordance with the present invention.

In FIG. 2 the expansion means 10 is shown in the form of an expansion nipple, but in other embodiments the expansion means 10 may for example be a simple, straight tube or a hollow cable. The function of the expansion means 10 is to allow expansion of the rock bolt 7, and thereby anchorage of the rock bolt 7 in the rock 12. Expansion requires only that the expansion means 10 comprises some kind of hollow body, through which for example water may be fed in under high pressure, whereby the rock bolt 7 expands to abutment against the borehole. An expansion nipple is advantageous in that the pressurization may then be performed by means of a radial injection tube, whereby a manual pressurization is facilitated.

The expansion means 10 preferably fits into an ordinary standard chuck for rock bolt used in rock bolting, and a specially designed chuck is thus not needed for the rock bolt 7 in accordance with the present invention.

In the shown embodiment, the connection sleeve 8 comprises a flange 13 against which a rock plate 14 abuts. Means other than a flange are also conceivable as support for a rock plate 14. By the fact that a rock plate 14 thus may be used in conjunction with the rock bolt 7, the rock bolt 7 may be used also as supporting of rock, which is not possible with prior art suspension devices. The rock plate 14 may be an ordinary, flat plate or may be domed, as is shown in the figure.

Figure 3:
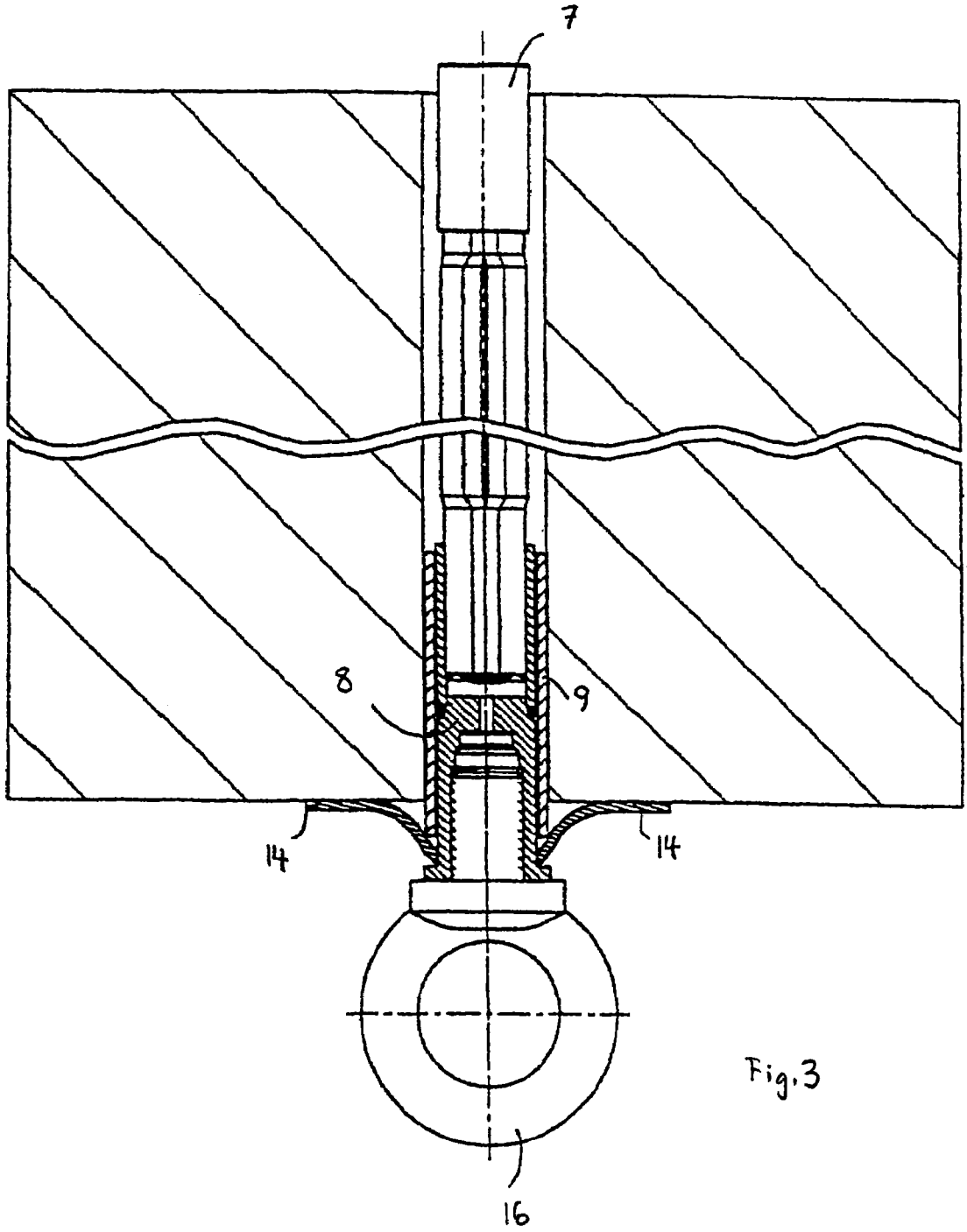
FIG. 3 shows the rock bolt of FIG. 1, where the detachable expansion nipple has been replaced with a mounting lug.
Figure 4A:
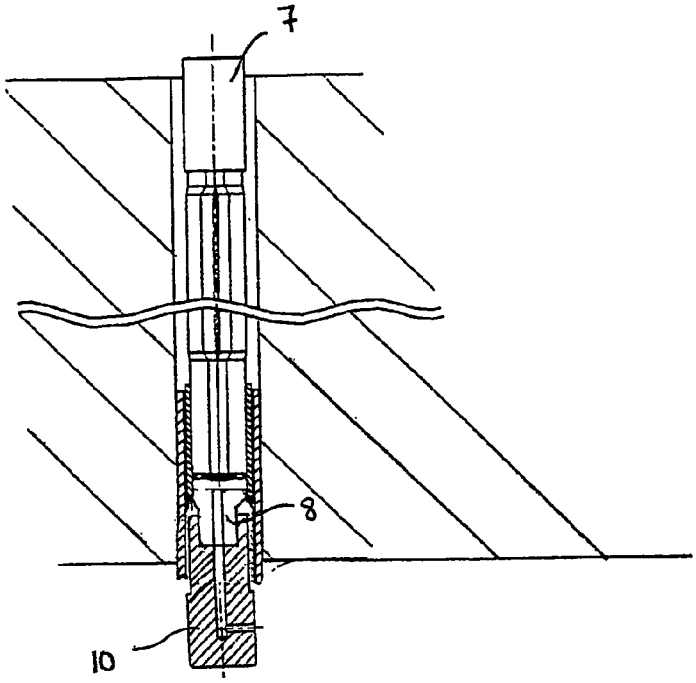
FIGS. 4*a* and 4*b* show a second embodiment of a rock bolt provided with a detachable expansion nipple and mounting lug, respectively, in accordance with the present invention.
Figure 4B:
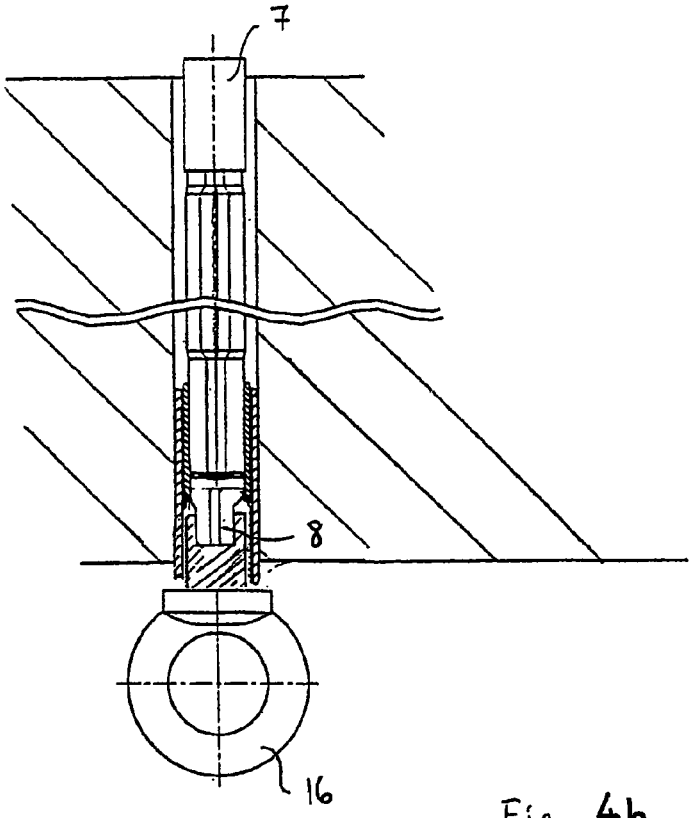

When the rock bolt 7 has been expanded by means of the expansion means 10, which expansion means 10 has been connected to a source of the pressure media, not shown, the expansion means 10 may be unscrewed. This provides a rock bolt giving a small protrusion. It is also possible, if desired, to connect a suspension element 16, see FIG. 3. The rock bolt 7 may thereby be used as a suspension device for e.g. service platforms and the like. The suspension element 16 is provided with means for interaction with the connection sleeve's 8 internal (or external) means 11, for example screw threads. In FIG. 3 the suspension element 16 is shown in the form of a mounting lug, but in alternative embodiments the suspension element 16 may comprise any suitable suspension means, for example a single hook, a double hook, a crook or any combination of these. A flexible suspension device, which may be adjusted according to need, is thus provided.

Moreover, the suspension element 16 may be unscrewed and be reused as the tunneling is advancing. This gives at least two advantages. Firstly, the cost for the suspension element 16 is reduced, since it may be used several times. Secondly, the protrusion from the rock is small, whereby the need for cutting bolts after use is eliminated, which otherwise is a time-consuming process. Thereby the procedure is speeded up, and moreover, the required thickness of the covering with rendering concrete or the like is reduced, which per se again reduces the costs. The installation is further very fast, with only a few, simply assembled parts.

Figure 5:
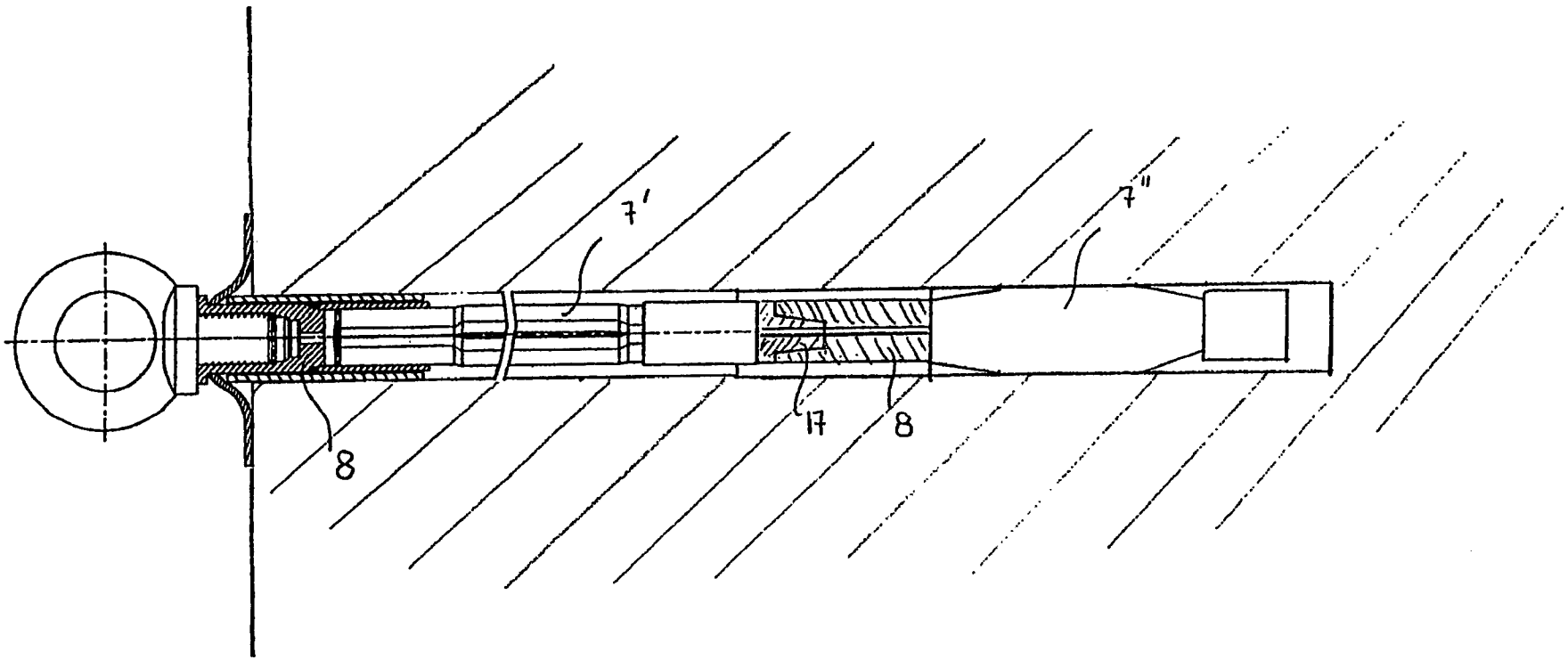
FIG. 5 shows two rock bolts in accordance with the present invention that has been joined.

As is shown in FIG. 5 the connection unit may be adjusted so that two and more rock bolts 7', 7" may be joined together in order to form a long bolt. This may be done in different ways. If one wishes to join together two rock bolts 7', 7" in accordance with the present invention, an outer rock bolt 7' has to have a through cable with a connection nipple 17, that are joined together with a connection sleeve 8 on an internal rock bolt 7". Application of a pressure media external to the borehole then entails expansion of both bolts 7' and 7".

The inner part of the rock bolt 7 may alternatively be exchanged to a male mounting that is pieced together with an ordinary expandable rock bolt. The rock bolt 7 in accordance with the present invention is then used only as the outermost part, protruding from the rock, while regular jointed expandable rock drills are used farthest in, in the rock 12.

The invention claimed is:

1. A rock bolting system comprising an expandable rock bolt for insertion in a borehole and expandable by means of a pressure media and including a connection unit, an expansion means for expansion of the rock bolt, and a suspension element for interaction with the connection unit of the rock bolt, wherein the rock bolt connection unit is designed with such external dimensions so as to be insertable into the borehole, characterized in, that the connection unit comprises means for detachable interaction with the expansion means as well as with the suspension element connectable to the rock bolt, and that the connection unit comprises a supporting sleeve surrounding at least parts of a seat of the connection unit where the supporting sleeve supports against the wall of the borehole for preventing any undesired angular displacements between the connection unit and the rest of the rock bolt.

2. The rock bolting system as claimed in claim 1, characterized in that the connection unit comprises a connection sleeve (8) fastened to the rock bolt (7).

3. The rock bolting system as claimed in claim 2, characterized in that the connection sleeve (8) comprises abutment means, against which a rock plate (14) may abut.

4. The rock bolting system as claimed in claim 3, characterized in that the expansion means (10) comprises a nipple that may be inserted into the connection unit.

5. The rock bolting system as claimed in claim 3, wherein said abutment means comprises a flange (13).

6. The rock bolting system as claimed in claim 2, characterized in that the expansion means (10) comprises a nipple that may be inserted into the connection unit.

7. The rock bolting system as claimed in claim 1, characterized in that the connection unit is fastened to the rock bolt (7) by welding.

8. The rock bolting system as claimed in claim 1, characterized in that the expansion means (10) comprises a nipple that may be inserted into the connection unit.

9. The rock bolting system as claimed in claim 1, characterized in that the rock bolt (7') present a through canal and a connection nipple (17) on a internal part for connection to a second rock bolt (7").

10. The rock bolting system as claimed in claim 1, characterized in that the suspension element (16) comprises one of the following: a mounting lug, a single hook, a double hook, a crook or a combination thereof.

* * * * *